US009241565B2

(12) United States Patent
Price

(10) Patent No.: US 9,241,565 B2
(45) Date of Patent: Jan. 26, 2016

(54) COOLER STORAGE RACKS

(71) Applicant: Ursula Price, Burlington, TX (US)

(72) Inventor: Ursula Price, Burlington, TX (US)

( * ) Notice: Subject to any disclaimer, the term of this patent is extended or adjusted under 35 U.S.C. 154(b) by 341 days.

(21) Appl. No.: 13/675,800

(22) Filed: Nov. 13, 2012

(65) Prior Publication Data

US 2013/0119070 A1 May 16, 2013

Related U.S. Application Data

(60) Provisional application No. 61/558,258, filed on Nov. 10, 2012.

(51) Int. Cl.

| | |
|---|---|
| ***A47H 1/16*** | (2006.01) |
| ***A47B 55/00*** | (2006.01) |
| ***B65D 81/18*** | (2006.01) |
| ***A47B 81/00*** | (2006.01) |
| ***F25D 25/00*** | (2006.01) |

(52) U.S. Cl.

CPC ..... *A47B 55/00* (2013.01); *A47B 81/00* (2013.01); *B65D 81/18* (2013.01); *F25D 25/00* (2013.01)

(58) Field of Classification Search

CPC ..... A47B 55/00; A47B 81/00; B65D 81/18; F25D 81/18; F25D 25/00

USPC ..... 248/220.41, 339; 211/71.01, 106; 220/475, 476, 480–482, 628, 630, 919

See application file for complete search history.

(56) References Cited

U.S. PATENT DOCUMENTS

| | | | | | |
|---|---|---|---|---|---|
| 846,758 | A | * | 3/1907 | Pike | 211/65 |
| 2,430,454 | A | * | 11/1947 | Cormier | 89/1.1 |
| D242,097 | S | * | 11/1976 | O'Neal | D6/552 |
| 5,203,462 | A | * | 4/1993 | Brooks | 211/14 |
| D634,184 | S | * | 3/2011 | Koehn | D8/373 |
| D643,704 | S | * | 8/2011 | Koehn | D8/370 |

* cited by examiner

*Primary Examiner* — Gwendolyn W Baxter
(74) *Attorney, Agent, or Firm* — The Villhard Patent Group; Robert L. Villhard

(57) ABSTRACT

Storage racks for coolers. Embodiments provide storage racks for coolers each of which includes a spacer and pairs of supports, standoff portions, and arms. The standoff portions couple with the supports while the arms couple with the standoff portions and are oriented along the first direction. The spacers couple with the arms; are oriented along a direction perpendicular to the first direction; and space the arms apart by the width of the coolers (or less). Some racks are continuous, curvilinear, and are made from rods or heavy gauge wire. The spacers can define straight or additional standoff portions. Further, the arms and spacers of some racks define a plane and the supports define another plane. These planes can intersect each other although they can be parallel.

20 Claims, 5 Drawing Sheets

COOLER STORAGE RACKS

RELATED APPLICATIONS

This application claims priority to and is a non-provisional application of U.S. Patent Application No. 61/558,258 filed on Nov. 10, 2011, titled "ICE CHEST STORAGE RACKS" by Ursula Price the entirety of which is incorporated herein as if set forth in full.

BACKGROUND

Commercial ice chests and other types of coolers allow users to store perishables and other items which they wish to maintain at some particular temperature (usually cooler than ambient). But, when closed for relatively long periods of time, these coolers tend to breed mold, mildew, etc. (hereinafter "mold") in the residual moisture left therein following their use. These organisms can even discolor the inside of the coolers (particularly near the bottom) and often produce a noxious musty odor. Cleaning the coolers prior to placing them in storage provides only partial relief. Sooner or later most closed coolers will produce troublesome mold unless thoroughly cleaned, dried, and disinfected prior to being placed in storage. The slime that can form from this mold can become a health concern particularly if the establishment that owns the affected cooler serves food or beverages therefrom.

Some commercially used coolers aggravate such problems due to the nature of their use. For instance, coolers used in marine settings (such as on fishing boats, bait shops, etc.) are often used to store organic materials. In some cases, that material might be bait, fish, etc. These objects themselves (and perhaps even material carried into the coolers on these objects) can foster the growth of mold by providing moisture, nutrients, etc. for the same. Residual amounts of these materials left behind in the coolers during storage therefore often accelerate the growth of mold and might even begin to emit odors of their own as they age, rot, etc.

Many users attempt to overcome these difficulties by propping open the lids of their coolers. But this sort of solution requires that some object remain lodged in the cooler for perhaps extended periods of time. If, as it often happens, that object is removed then the problems discussed above result anyway. When a user opens one of these closed coolers the foul odors trapped therein escape causing discomfort to those in proximity to the cooler. Moreover, in a commercial setting, propping open a cooler looks tacky and can discourage customers from interacting with the establishment not to mention the loss of otherwise useful floor space that the stored cooler occupies.

In addition, cleaning one of these fouled coolers usually requires large amounts of water, relatively hazardous materials (for instance, bleach), more water to rinse the cleaned cooler of the cleaning chemicals, and time for the cooler to dry. Otherwise, the hazardous chemicals and/or moisture on (or in) the cooler can contaminate food, beverages, and/or ice placed therein as well as damaging, discoloring, or staining furniture, clothing, etc. which might come into contact with the cooler.

While the cooler dries, in addition, many users leave the cooler on its side on a sidewalk, garage floor, patio, pavement, lawn, etc. where they obstruct traffic and take up needed space. Moreover, while lying in the open, the coolers can be caught by gusts of wind or otherwise upended thereby exposing the lid hinges to damage from impacts and the body of the cooler to scuffs, scratches, dents, cracks, etc. In such cases, the damaged parts might need to be replaced or repaired. But, in other cases, the user simply uses the damaged cooler or throws it away and purchases another one.

Moreover, sometimes users store their coolers by placing or stacking them against an exterior wall such as those found near where coolers are used (for instance, near a point of sale of food and beverages that might be sold therefrom). These stored coolers, of course, remain exposed to wind, sun, and rain. They are thus susceptable to wind damage as well as becoming brittled, faded, discolored, etc. due to the effects of potentially strong ultraviolet light from the sun. Then, again, the wind-blown rain (and other debris such as dirt, dust, grass clippings, etc.) can infiltrate the stored coolers leading to the very problem, mold and its odor, that the user wished to avoid thereby necessitating a re-cleaning before use. And, even if the stored coolers remain clean, dry, and in good condition, there presence can be or become an eye sore.

SUMMARY

The following presents a simplified summary in order to provide a basic understanding of some aspects of the disclosed subject matter. This summary is not an extensive overview of the disclosed subject matter, and is not intended to identify key/critical elements or to delineate the scope of such subject matter. A purpose of the summary is to present some concepts in a simplified form as a prelude to the more detailed disclosure that is presented herein. The current disclosure provides systems, apparatus, methods, etc. for storing coolers and more particularly for storing coolers in an inverted, hanging position in which the cooler is open.

Storage racks in accordance with embodiments are available from the Nomusti Company of Cameron, Tex. These storage racks allow users to clean their coolers, flip them up on to the storage racks, let the coolers dry thereon, and then remain there in storage for extended times if desired. Thus, these storage racks help keep coolers clean, odor free, and ready for use. They also eliminate or reduce the tasks, challenges, and expenses associated with cleaning and storing coolers using approaches heretofore available. Various storage racks in accordance with embodiments work with all (or at least a large majority) of available coolers in their various sizes, makes, models, etc. Furthermore, these storage racks can be easy to install and can require no assembly. They can also be fabricated from a single, continuous piece of feedstock thereby facilitating their manufacture at relatively low cost.

Some embodiments provide apparatus which include coolers and storage racks for the same. The storage racks of the current embodiment are continuous and curvilinear and are no larger than about 20 inches wide by about 16 inches in height by about 8 inches deep. Moreover, these storage racks are formed from a rod and define the following pairs of portions: a first and a second support, a first and second standoff portion, and a first and second arm. In addition, the storage racks define a spacer. The first standoff portion is coupled to the first support and defines a first direction. The first arm is coupled to the first standoff portion and is at least partially oriented along that first direction. The second support, the second standoff portion, and second arm are coupled together in a manner similar to their counterparts and are also symmetrical. The spacer couples with the first and second arms and defines a second direction which is perpendicular to the first direction. Moreover, the spacer spaces apart the first and second arms by no more than about the width of the cooler so that the cooler hangs from the storage-rack generally in an inverted orientation. Some storage racks of the current embodiment are no more than about 14½ inches wide by about 6½ inches in height by about 8 inches deep.

Various embodiments provide storage racks for coolers each of which defines a depth, a height, and a first side and a second side spaced apart by a width, In the current embodiment the storage racks each include a support, an standoff portion, an arm, a spacer and a second support, a second standoff portion, and a second arm. The standoff portions are coupled to the supports which define a first direction while the arms are coupled to the standoff portions and are at least partially oriented along the first direction. Spacers of the current embodiment couple to the arms; are at least partially oriented along a second direction generally perpendicular to the first direction; and space the arms apart by no more than about the width of the cooler.

Some embodiments provide apparatus wherein the cooler further includes a lid and the lid hangs in an open position when the cooler is stored on the storage rack. In some cases, though, the cooler includes a zipper and the zipper is open so that the cooler can be store on the storage rack. Storage racks of some embodiments are about 20 inches wide by about 16½ inches in height by about 8 inches deep. But, storage racks of some embodiments are about 6½ inches wide by about 14 inches in height by about 8 inches deep. In some embodiments, the storage-rack is a continuous, curvilinear, and heavy gauge wire. Some storage racks, though, are formed from continuous, curvilinear rods.

In some embodiments, the supports define loops. But, the supports can define swaged areas or loops or can be standing or hanging supports. As to the spacers, they can define straight portions and/or additional standoff portions. In addition, or in the alternative, the arms and spacer of particular storage racks define a plane and the supports define another plane. If desired the planes can intersect each other although they can be parallel.

To the accomplishment of the foregoing and related ends, certain illustrative aspects are described herein in connection with the annexed figures. These aspects are indicative of various non-limiting ways in which the disclosed subject matter may be practiced, all of which are intended to be within the scope of the disclosed subject matter. Other advantages and novel features will become apparent from the following detailed disclosure when considered in conjunction with the figures and are also within the scope of the disclosure.

BRIEF DESCRIPTION OF THE FIGURES

The detailed description is described with reference to the accompanying figures. In the figures, the left-most digit(s) of a reference number usually corresponds to the figure in which the reference number first appears. The use of the same reference numbers in different figures indicates similar or identical items.

DETAILED DESCRIPTION

This document discloses systems, apparatus, methods, etc. for storing coolers and more particularly for storing coolers in an inverted, hanging position in which the cooler is open.

Figure 1:
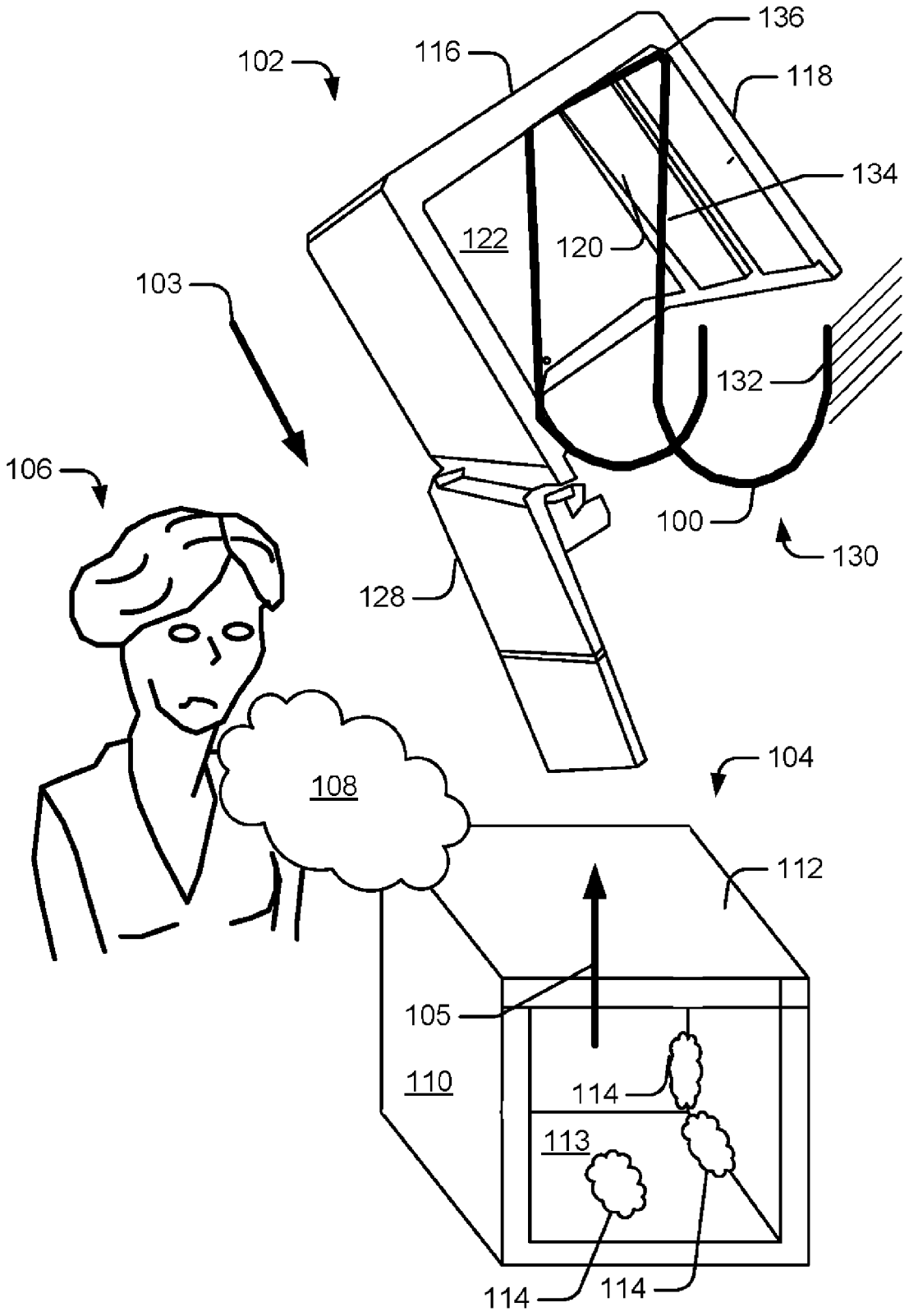
FIG. 1 illustrates a cooler storage rack.

FIG. 1 illustrates a cooler storage rack. More specifically, FIG. 1 illustrates storage rack 100 holding cooler 102 for storage in a first orientation (see arrow 103) in accordance with embodiments. FIG. 1 also illustrates another cooler 104 stored in a second orientation 105 in a conventional manner. As illustrated, the two orientations 103 and 105 (and hence coolers 102 and 104) are inverted from one another and colloquially, cooler 102 can be said to be stored upside down whereas cooler 104 can be said to be stored right side up.

With further reference to FIG. 1, a user 106 is shown in relatively close proximity to cooler 104 and the noxious odors 108 entrapped in and perhaps emanating from cooler 104. These noxious odors 108 arise in many situations because the cooler 104 has been stored for some period of time in its upright orientation. As a result, its lid 112 became closed at some point either by a deliberate or an inadvertent action by the user 106 or it might have fallen shut at some point during its storage. Moisture and/or residue, debris, and/or the like trapped in the cooler 104 therefore has allowed mold to grow in cooler 104 thereby creating the noxious odors 108 and perhaps even staining, discoloring, or perhaps even chemically attacking the cooler 104 in certain areas.

Cooler 104 includes various sides 110 (or side panels) and the lid 112 along with a bottom 113. Together, these various portions of the cooler tend to form a relatively air tight enclosure within which the user 106 can store various items for relatively short periods of time. Due to the airtight nature of the cooler 104 and the materials of construction thereof, the cooler 104 often has the ability to maintain these stored objects at temperatures that might differ greatly from the surrounding, ambient environment. In some cases, the storage enclosure might be maintained at temperatures warmer than the surroundings. It often happens, though, that the cooler 104 maintains that enclosure at a temperature less than the surroundings and is deemed a "cooler" even though it can perform both functions and perhaps others.

It is also noted here that while the cooler 104 is said to be airtight, that designation does not necessarily imply a hermitic device. Rather, the various portions of the cooler 104, acting in concert, at least restrict air movement into and out of the enclosed space which they define. Much the same can be said for cooler 102. As a result, when the lid 112 of the cooler 104 is in a closed position for relatively long periods of time, the mold 114 tends to grow and create the noxious odors 108. Since many users 106 find these noxious odors 108 aesthetically dis-pleasing, it might be desirable to store coolers in a manner that eliminates or, at least, diminishes these noxious odors 108. Moreover, as noted elsewhere herein, this mold can create a health issue in some commercial settings.

With continuing reference to FIG. 1, this drawing also illustrates that cooler 102 includes a bottom 116, a front side 118, a back side 120, a first side panel 122, a second side panel (not shown), and a lid 128. FIG. 1 further illustrates that the cooler 102 defines an opening or enclosed space 130 defined by the various sides 118, 120, 122, the bottom 116, and the lid 128 (when closed). FIG. 1 also illustrates that storage rack 100 includes a support 132, an arm 134, and a spacer 136 extending from the arm 134 into the enclosed space 130.

Thus, FIG. 1 illustrates a number of aspects of the current embodiment. For instance, cooler 102 hangs from the storage rack 100 in its inverted orientation 103. Moreover, the lid 112, being on the (inverted) underside of the cooler 102 hangs from its hinge in an open position allowing more or less unrestricted exchange of air between the enclosed space 130 and the surroundings. Furthermore, the arm 134 and support 132 can be shaped and diminished such that the cooler 102 makes contact with (or hangs from) one or both of the same. Moreover, the arm 134 and support 132 can be further shaped and diminished such that they allow sufficient clearance between the cooler (or perhaps the back panel of the cooler) and themselves so as to allow the user to place the cooler 102 on the storage rack 100 without a great deal of attention to aligning the cooler 102 with the storage rack 100 prior to placing it there.

Storage racks of embodiments are sized and configured in accordance with the cooler(s) which they can store. For instance, storage racks 200 (see FIGS. 2-4) can be used with coolers having at least one internal dimension (usually their width) greater than 20 inches. These types of coolers often have storage capacities of 48 quarts or more. For instance, certain currently available coolers 102 made by the Igloo Products Corp. of Katy, Tex. (for instance, the Yukon™ line of coolers) and the Tundra™ line of coolers available from Yeti Coolers of Austin, Tex. have capacities up to 120 and 420 quarts respectively. Of course, storage racks 200 of embodiments can be designed to store both larger and smaller coolers 102. For instance, storage racks of various embodiments can be formed from ⅜ inch diameter rods and/or appropriately sized wire to withstand the weight of the coolers 102. It is noted here that coolers 102 of 32 quart, 48 quart, and 120 quart capacities have found popularity in the market place and, accordingly, storage racks 200 of embodiments can be sized to store such coolers 102 in commercial spaces, garages, indoors, outdoors, and other areas.

Figure 2:
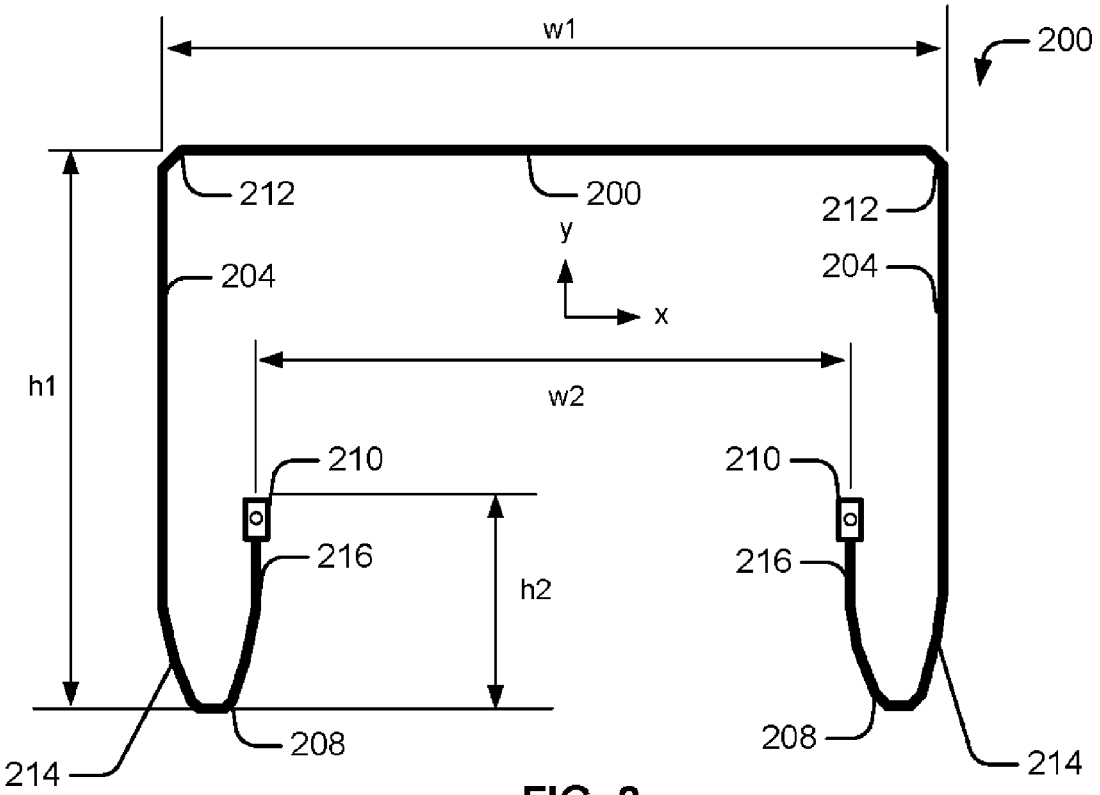
FIG. 2 illustrates a front elevation view of a cooler storage rack.
Figure 3:
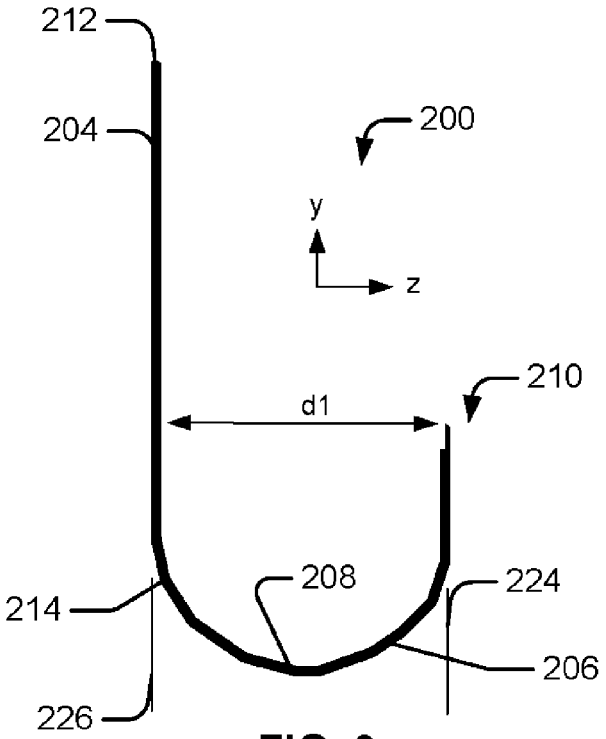
FIG. 3 illustrates a side elevation view of a cooler storage rack.
Figure 4:
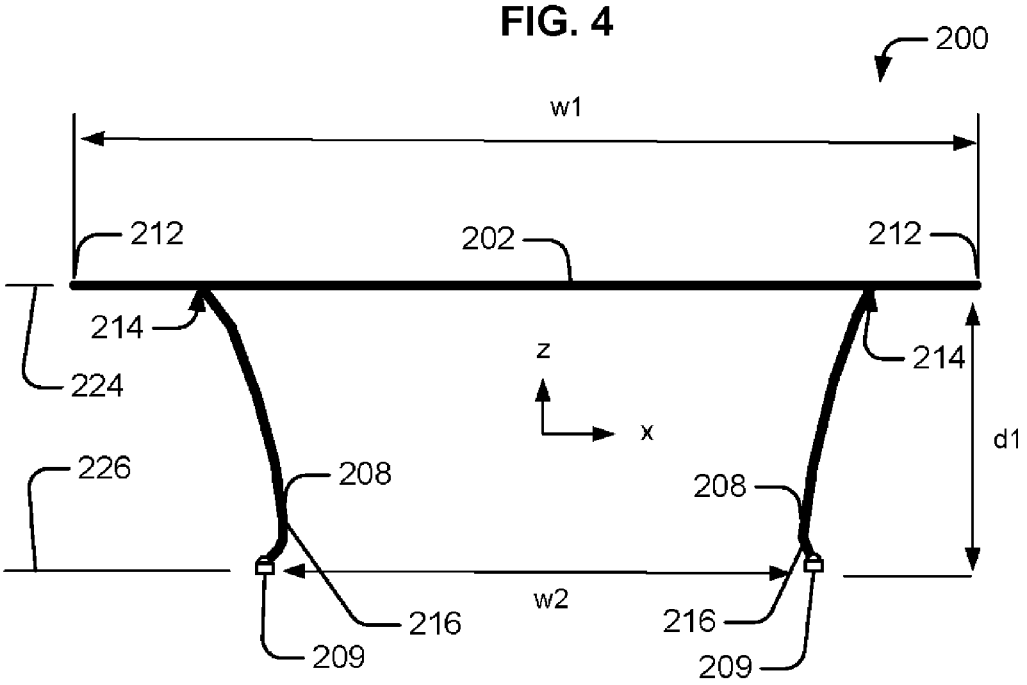
FIG. 4 illustrates a top plan view of a cooler storage rack.

With reference now FIGS. 2-4 a cooler storage rack of embodiments is disclosed. More specifically, FIG. 2 illustrates a front elevation view of the cooler storage rack; FIG. 3 illustrates a side elevation view of the cooler storage rack; and FIG. 4 illustrates a top plan view of the cooler storage rack. The storage rack 200 can be formed from a rod, heavy gauge wire, etc. and can be a continuous, curvilinear apparatus. Moreover, the storage rack 200 of the current embodiment includes a spacer 202 and a pair (each) of arms 204, standoff portions 208, and supports 210. The storage rack 200 also includes a pair of bends 212 and various other portions 214 and 216. Moreover, FIG. 2 also illustrates a y-axis defining a first direction which might be vertical and an x-axis defining a second direction which might be horizontal. Thus, the first and second directions can be perpendicular to each other. In addition, a z-axis (see FIG. 3) can define a third direction which is perpendicular to both of the first and second directions.

With continuing reference to FIGS. 2-4 it might now be helpful to disclose further aspects of the various potions of the storage rack 200. For instance, supports 210 can be configured to include a flattened or swaged portion including or defining a hole(s) through which a fastener (not shown) can be inserted. The support 210 can therefore be fastened to a wall or other structure with the portions 216 of the supports (extending downwardly therefrom and) abutting the wall. Thus, when a cooler 102 is hanging from the storage rack, the weight of the cooler will tend to force the portions 216 of the supports 210 against the wall thereby lending stability to the overall system while spreading the resulting forces across a portion of the wall. It is noted here that commercially sized coolers can weigh on the order of 100-200 pounds and that spreading the resulting forces might be desirable in some circumstances. It has been found that 2-4 inches of contact between the load spreading portions 216 and the wall is usually sufficient to spread the loads.

From the portions 216, the standoff portions 208 can extend in two or more directions. For instance, the standoff portions 208 can extend along the third direction (defined by the z axis) away from the wall (or the supports 210) to allow some space between a cooler being placed on the storage rack and the wall. But, it can also extend along the second direction (defined by the x axis) either inwardly toward the middle of the storage rack 200 or outwardly therefrom (as shown in FIG. 4). Thus, the standoff portion 208 can allow for the supports 210 to be spaced apart at any convenient distance while the spacer 202 (to be discussed) can define another distance or width w1. In some cases, the supports 210 can be spaced apart by about the distance w2 between studs in many walls (12 inches, 16 inches, etc.). Thus, the spacer 202 can be dimensioned independently of the space between those studs to allow coolers of various configurations to be stored on the storage rack 200. It is noted here that some standoff portions 208 are roughly semicircular in shape. But other shapes are within the scope of the disclosure.

From the standoff portions 208, the portions 214 extend outwardly to the arms 204. The arms 204 of the current embodiment extend from there along the first direction and, thus, in many cases vertically. See FIG. 2. Note that the arms 204 can define the overall height h1 of the storage rack 100. That height h1 can correspond to a particular type of cooler 102 if desired. Moreover, the height h1 can be significantly larger than the height h2 of the supports 210 (including the load spreading portion 216) if desired. In other words, whereas the height h2 can allow the supports 210 (and portions 216) to spread the load of the storage rack 200 and cooler 102 against the wall, the height h1 can be such that the arms 204 (and spacer 202) fully (or partially) engage the cooler 102 in the enclosed space 130 to keep the cooler 102 from moving appreciably while stored on the storage rack 200.

Meanwhile, the depth d1 (see FIG. 3) can be sufficiently large so that the user 106 need not exercise more than casual care in positioning the cooler 102 on the storage rack relative to the arms 204 and wall. It has been found that a depth d1 of about 8 inches is sufficient for these purposes.

From the arms 204, bends 212 (of perhaps 90 degrees) can extend to the spacer 202. Further, the spacer 202 (and/or bends 212) can define the overall width w1 (along the second direction) of the storage rack 200. That width w1 can correspond to the overall (internal) width of the cooler 102. Or, if desired, it can be somewhat less than that distance to facilitate placement of the cooler on the storage rack. In either case, the width w1 of the storage rack 200 can be selected to provide a desired balance between allowing a user to conveniently slip the cooler 102 over the storage rack 200 while limiting movement of the cooler 102 while it is stored on the storage rack 200.

FIG. 2 also illustrates that the storage rack 200 can be symmetrical. More specifically, the y-axis can bifurcate the spacer 202 and the pairs of arms 204, standoff portions 208, and supports 210 (and associated portions 214 and 216). While perhaps aesthetically pleasing, such symmetry is not necessary for the practice of the current embodiment. Meanwhile, FIG. 3 illustrates other aspects of storage racks 200 of the current embodiment. For instance, the supports 208 and or associated portions 216 can define a plane 224 (viewed edge on) while the arms 204 can define a second plane 226 (also viewed edge on). FIG. 3 also illustrates that the planes 224 and 226 can be parallel although they could intersect at an angle if desired.

With continuing reference to FIGS. 2-4, one embodiment provides storage racks 200 having a width w1 of about 6½ inches, a height h1 of about 14½ inches, and a depth d1 of about 8 inches. Furthermore, storage racks 200 of the current embodiment can be formed from ⅜ inch diameter, cold-rolled, stainless steel (or instance T-304 or 6 GA CRS C-1008) rods. Such storage racks 200 are therefore useful for storing hard-sided coolers 102 having interior widths less than about 20 inches. Moreover, because of their stainless steel construction such storage racks 200 can be used in outdoor locations where corrosion, rust, etc. might be expected (and even those locations in which they might be exposed to salt spray or water). If desired, further corrosion resistance can be added to various storage racks 200 by powder coating (or otherwise treating by painting for instance) the surfaces thereof. Note that powder coating also allows various colors to be applied to the storage racks 200 if desired. Moreover, storage racks 200 of the current embodiment tend to be relatively lightweight (on the order of about 3 pounds).

Table 1, lists some non-limiting information regarding various coolers available from the Igloo Products Corp. which can be stored on storage racks of the current embodiment.

Yet another embodiment provides storage racks 200 suitable for storing coolers 102 with internal widths greater than about 20 inches. Such storage racks can be used with coolers typically having capacities between 48 and 120 quarts. But even larger coolers can be accommodated by storage racks 200 of various embodiments. These storage racks 200 can also be formed from stainless steel rods of ⅜ inch diameter. Other materials and sizes, though, can be used if desired. To accommodate these relatively large coolers 102, storage racks of the current embodiment can have overall dimensions of about 20 inches for their widths w1, about 16½ inches for their heights h1, and about 8 inches for their depths d1. Typically, these storage racks 200 will weigh on the order of about 3.5 pounds and will be configured to mount on 16-inch centers although other configurations are within the scope of the current disclosure.

Table 2, lists some non-limiting information regarding various coolers available from the Igloo Products Corp. which can be stored on storage racks of the current embodiment.

TABLE 1

| CATEGORY | MODEL | WEIGHT (lbs.) | DIMS. L × W × H (in.) | Notes |
|---|---|---|---|---|
| BOATING & FISHING | RealTree Gripper 18 can | 1.124 | 11 × 9 × 10 | Softside |
| | Realtree HLC 24 can | 2.85 | 19.1 × 10.77 × 11.38 | Softside |
| | DUFFLE | | | |
| | Marine Breeze 28 Roller | 8.67 | 18.375 × 13.312 × 16.2 | Roller |
| | Playmate The Boss | 3.7 | 14.5 × 10.51 × 13.61 | Swinger |
| | PlaYmate Max Cold Tent Top | 3.48 | 16.5 × 10.5 × 17.25 | Softside |
| GREAT OUTDOORS | Realtree 18 can | | | Softside |
| | Realtree HLC 24 can | | | Softside |
| | Duffle | | | |
| | 9 Quart Island Breeze | 3.035 | 13.02 × 9.52 × 8.875 | |
| | 28 Quart Island Breeze | 6.753 | 18.253 × 12.5 × 15.385 | |
| | 28 Quart Island Breeze Roller | 8.67 | | |
| GOLF & TURF | 30 QT. Contour Sportsman | | 18.415 × 13.251 × 16.811x | |
| | Playmate Gripper 22 can | | | softside |
| | Playmate Gripper 9 can | 0.8 | 9 × 7 × 10.5 | softside |
| | 6 can Legend | 2.2 | 8.5 × 6.38 × 5.88 | softside |
| | Igloo HLC 9 can | 1.15 | 11.14 × 8.59 × 8.66 | softside |
| HUNTING | 30 Qt. Contour Sportsman | | | |
| SMALL GROUP | Shopping Tote 30 | 0.8 | 18.5 × 3.5 × 12.8 | softside |
| | Cooler Tote 16 | 0.6 | 13.25 × 4.25 × 11.25 | softside |
| | Realtree HLC 24 can | | | |
| | 28 Qt. Island Breeze | | | |
| | 28 Qt. Island Breeze Roller | | | |
| Personal Size | Mini Tote 6 | 0.2 | 5.91 × 12.05 × 8.03 | |
| | Cooler Tote 16 | 0.6 | 13.25 × 4.25 × 11.25 | |
| | 30 qt Contour | | 15.415 × 13.251 × 16.811 | |
| | Realtree 18 can | | | |
| | 9 Qt. Island Breeze | | | |
| | Tundra 35 | 17 | 14⅝ × 10½ × 11¼ | |
| | Tundra 45 | 22 | 18.875 × 10⅝ × 11½ | |
| | Tundra 50 | 25 | 17⅜ × 11⅛ × 13⅛ | |

TABLE 2

| CATEGORY | MODEL | WEIGHT (lbs.) | DIMS. (in.) L × W × H |
|---|---|---|---|
| BOATING & FISHING | 120 Qt Polar | 18.2 | 38.31 × 17.38 × 17.75 |
| | Glide Pro | | 39.671 × 18.623 × 19.742 |
| | Yukon 50 | 32.1 | 33.581 × 17.026 × 17.55 |
| | Yukon 70 | 36.4 | 24.9 × 10.9 × 14.6 |
| | Yukon 150 | 60.5 | 38.0 × 15.8 × 14.6 |
| GREAT OUTDOORS | 48 QT. Island Breeze | 9.22 | 25.562 × 14.062 × 14.125 |
| | 50 QT Max Cold Roller | 16.75 | 27.5 × 16.75 × 19.063 |
| | 60 QT Island Breeze Roller | 15.162 | 27.5 × 16.75 × 19.063 |
| | 60 QT Ice Cube Roller | 13.5 | 20 × 18.5 × 20.69 |
| | 120 Quart Polar | | |
| GOLF & TURF | 52 Quart Sportsman | 8.1 | 21.5 × 11.5 × 11.25 |
| | 100 Quart Sportsman | 17.5 | 31.31 × 14.88 × 12.19 |
| HUNTING | 52 Quart Sportsman | | |
| | 100 Quart Sportsman | | |
| LARGE GROUP | 70 Quart Legend | 11.6 | 29.5 × 16.5 × 16.13 |
| | 60 Quart Island Breeze Roller | | |
| | 50 Quart Island Breeze Roller | | |
| | 48 Quart Island Breeze Roller | | |
| | 120 Quart Polar | | |

Table 3, lists some non-limiting information regarding various coolers available from Yeti Coolers which can be stored on storage racks of the current embodiment.

TABLE 3

| MODEL | WEIGHT (lbs.) | DIMS (in.) |
|---|---|---|
| Tundra 65 | 27 | 24⅜ × 12 12 |
| Tundra 75 | 30 | 26⅜ × 11⅝ × 12¼ |
| Tundra 105 | 33 | 23¾ × 13⅝ × 15 5/16 |
| Tundra 110 | 37 | 30¼ × 11¼ × 14½ |
| Tundra 120 | 43 | 33⅝ × 13⅞ × 13⅞ |
| Tundra 125 | 47 | 32½ × 13⅛ × 15⅛ |
| Tundra 155 | 53 | 37½ × 13⅛ × 15⅛ |
| Tundra 160 | 54 | 37⅜ × 12⅞ × 15¾ |
| Tundra 250 | 77 | 48¼ × 17 × 17¼ |
| Tundra 420 | 110 | 56½ × 18¼ × 22⅞ |

Figure 5:
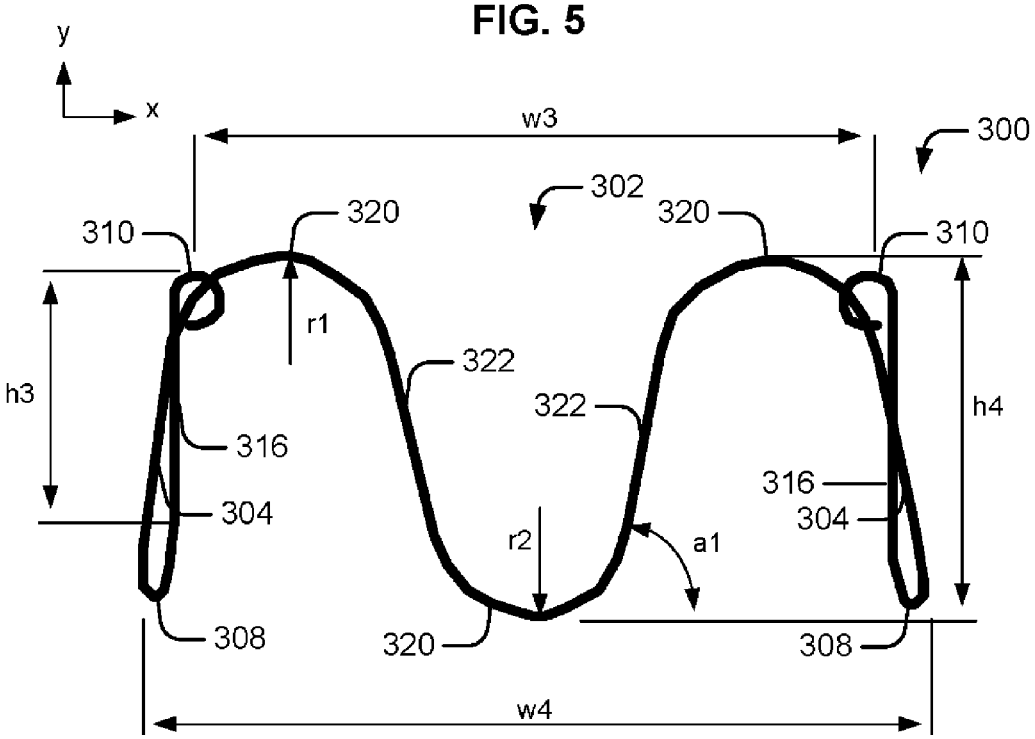
FIG. 5 illustrates a front elevation view of another cooler storage rack.
Figure 6:
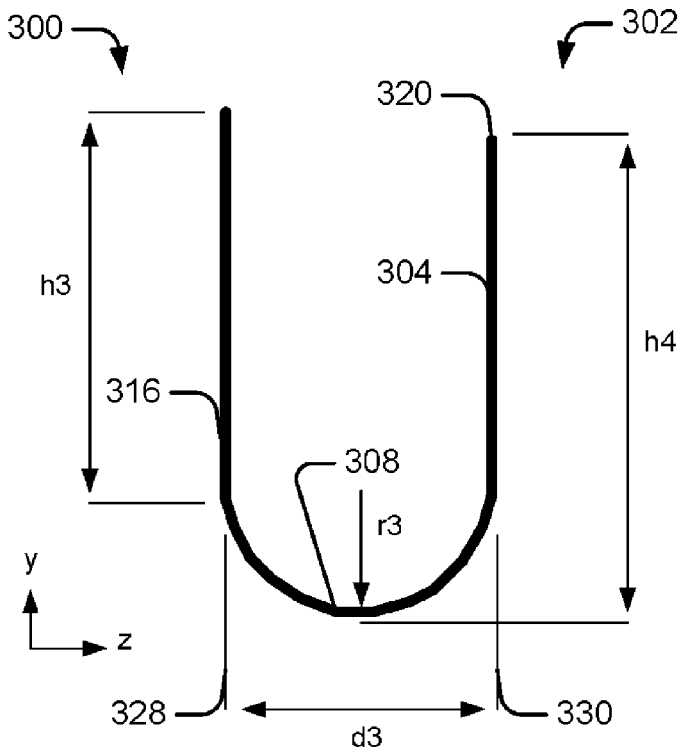
FIG. 6 illustrates a side elevation view of the other cooler storage rack.
Figure 7:
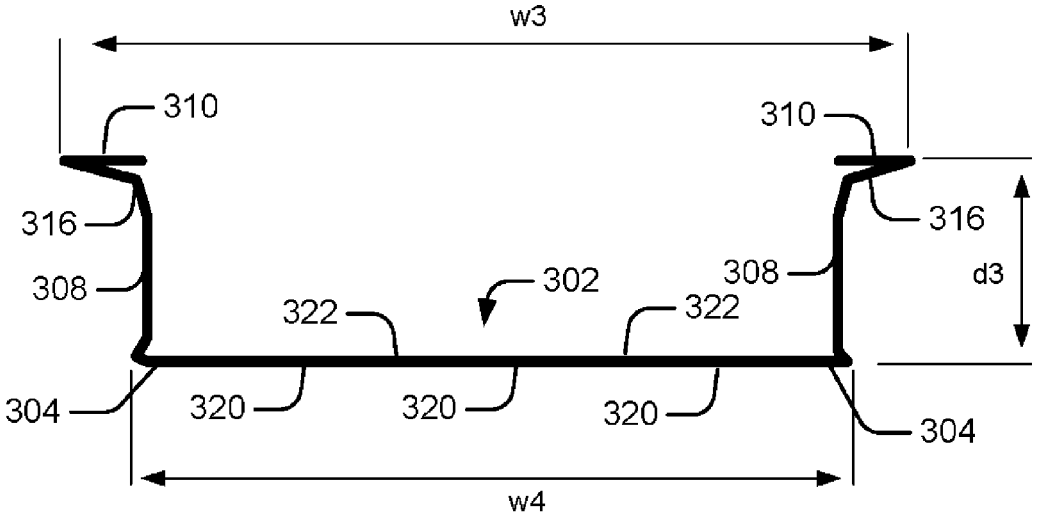
FIG. 7 illustrates a top plan view of the other cooler storage rack.

With reference now FIGS. 5-7 another cooler storage rack of is disclosed. More specifically, FIG. 5 illustrates a front elevation view of the other cooler storage rack; FIG. 6 illustrates a side elevation view of the other cooler storage rack; and FIG. 7 illustrates a top plan view of the other cooler storage rack. Whereas the storage rack 200 of FIGS. 2-4 can be sized and dimensioned for one or many types of hard-sided coolers, the storage rack 300 of FIGS. 5-7 can be sized and dimensioned for one or many types of soft-sided coolers. Of course, either type of storage rack 200 or 300 can be used with (or sized for) coolers of various sizes, shapes, configurations, etc. (whether hard or soft-sided) if desired.

With continuing reference to FIGS. 5-7, the storage rack 300 of the current embodiment includes a spacer 302, a pair of arms 304, a pair of standoff portions 308, a pair of supports 310, and a pair of load spreading portions 316. Again, although not necessary for the practice of the current embodiment, the arms 304, standoff portions 308, supports 310, and load spreading portions 316 happen to be symmetrical about the y-axis. Moreover, the spacer 302 includes a series of additional arcuate portions 320 joined by various spokes 322 to form an undulating portion of the storage rack 300. When a soft-sided cooler is placed on/over the storage rack 300 of the current embodiment, portions of the "bottom" interior of the cooler (and on opposite sides thereof) can rest on the upward pointing arcuate portions 320 of the spacer 302. If desired, the bottom of such coolers can droop or sag into the space between the two upward pointing arcuate portions 320 above the downward pointing arcuate portion 320 of the spacer 302. Thus, such storage racks can facilitate draining of water and other fluids from the interior of such coolers. In the alternative, or in addition, relatively small coolers can be stored on each of the upward pointing arcuate portions 320 thereby allowing one storage rack 300 to store multiple coolers.

As FIG. 5 shows, the supports 310 can each include a loop that defines an aperture for a fastener to hold the storage rack 300 against a wall or other structure. From there, a portion 316 of the support 310 can extend in a generally downward direction across a height h3 to spread the load from the storage rack 300 against the supporting structure. Furthermore, as illustrated by FIG. 6, the load spreading portions 316 can join with the standoff portions 308 which turn outward away from the supporting structure in a direction parallel to the z-axis as seen in FIG. 7. The standoff portions 308 create a depth d3 which allows some clearance between the wall and coolers being placed on the storage rack 300. The depth d3 can be about flinches in some cases. The standoff portions 308 also join with the arms 304 which join at their other end with the upward pointing arcuate portions 320 of the spacer 302. Moreover, stand off portions 308 can extend inwardly toward the middle of the spacer 302 or they can extend outwardly by some distance. Thus, the standoff portions 308 can allow the width w3 between the supports 308 to differ from the overall or maximum width w4 of the spacer 302.

Thus, the storage rack can define an overall width w3 between the supports and a width w4 that varies with the spreading of the arms 304. These arms can slope upward at an angle a1 of about 75-80 degrees as seen in an x-y plane (FIG. 5). Again, the width w3 between the supports 310 can be chosen to match the distances between studs in various walls (for instance, the width w3 can be 12 inches, 16 inches, or multiples thereof. Moreover, the overall width w3 and height can be chosen to correspond to that of the interior of the largest soft-sided cooler likely to be stored on the storage rack 300. Smaller soft-sided coolers, of course, can rest on the arms 304 of the storage rack 300 at a height where their width approximately matches the variable width w4 (or on the upwardly pointing arcuate portions 320).

The various standoff portions 308 and the arcuate portions 320 can have various radii such as radius r1 for either or both of the upward pointing arcuate portions 320, r2 for the downward pointing arcuate portion 320, and r3 for the standoff portions 308 between the support portions 316 and arms 304. The radii r3 can be chosen to help spread the soft-sided coolers likely to be stored on the storage rack 300 without unduly stretching the fabric thereof. The radius r2 and slopes of the arms 304 and spokes 322 can be chosen so as to produce the overall width w3 of the storage rack 300. The radius r3 (and the angle of departure of the arm 304 from the standoff portion 308 as shown in FIG. 6) can be chosen so as to allow a user to slip a soft-sided cooler over the storage rack 300 (or rather the spacer 302) without having to unduly maneuver the cooler around the various portions of the storage rack 300. Of course, the spacer 302 can define an overall height h4 via the arms 304, the spokes 322, and the arcuate portions 320 (and, if desired, the stand offs 308).

Moreover, the arcuate portions 320 are unlikely to tear the fabric of soft-sided coolers and are unlikely to chaff the sides of hard-sided coolers. Note that the bends 212 (see FIG. 2) serve similar purposes. In addition, storage racks 300 of the current embodiment can be fabricated by consecutively bending a continuous rod (or heavy-gauge wire) due to there only being standoff portions, loops, and straight portions in the storage racks 300. Embodiments illustrated in FIGS. 2-4 enjoy a similar, cost-effective fabrication method for similar reasons.

Table 3, lists some non-limiting information regarding various coolers available from Igloo Products Corp. which can be stored on storage racks of the current embodiment.

TABLE 4

| CATEGORY | MODEL | WEIGHT (lbs.) | DIMS. L × W × H (in.) |
|---|---|---|---|
| Personal Size | Mini Tote 6 | 0.2 | 5.91 × 12.05 × 8.03 |
| | Cooler Tote 16 | 0.6 | 13.25 × 4.25 × 11.25 |
| | 30 qt Contour | | 15.415 × 13.251 × 16.811 |
| | Realtree 18 can | 1.124 | 11 × 9 × 10 |
| | 9 Qt. Island Breeze | 3.035 | 13.02 × 9.52 × 8.875 |

Figure 8:
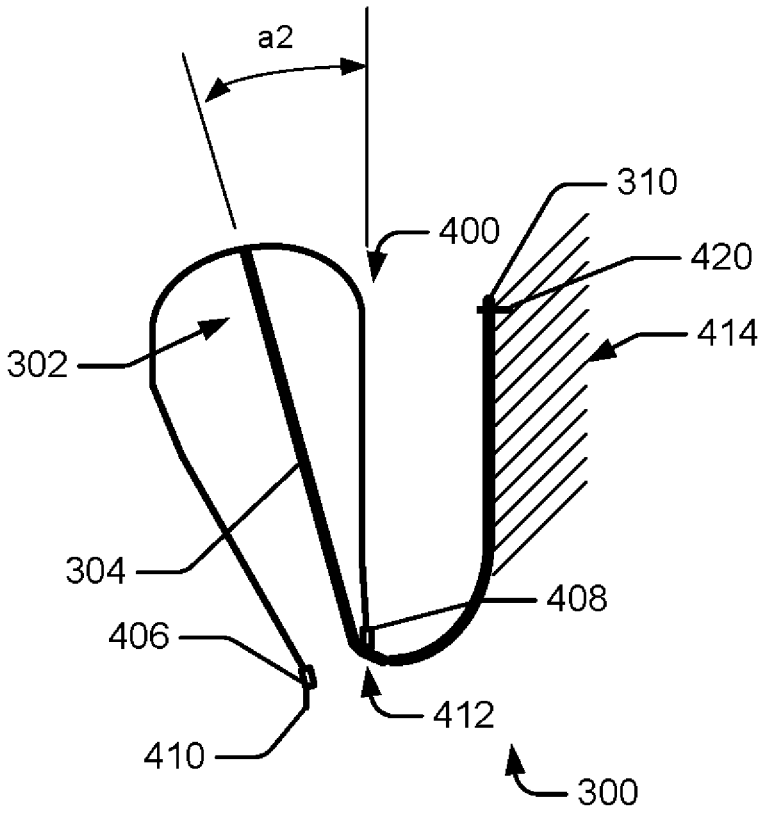
FIG. 8 illustrates a cross-sectional view of a soft-sided cooler on a cooler storage rack.

FIG. 8 illustrates a cross-sectional view of a soft-sided cooler on a storage rack. The cooler 400 rests on top of the storage rack 300 (see FIGS. 4-7) with the arms 304 and spacer 302 (not shown) spacing the sides of the cooler 400 apart. Of course, as illustrated, the cooler 400 is a soft-sided cooler and instead of a lid, it includes a zipper composed of two halves 406 and 408 and a pull tab or slider 410. When the zipper is open (the halves 406 and 408 are separated), the zipper and body of the cooler 400 define an enclosure or opening 412 through which the arms 304 of the storage rack 300 protrude when the cooler 400 is on the storage rack 300. FIG. 8 also illustrates a wall 414 (or other support structure) and a fastener 420 holding one of the supports 310 of the storage rack 300 against the wall 414. If desired, the spacer 302 can angle away from the supports 310 (and wall) by an angle a2.

Thus, storage racks 300 of the current embodiment can be used with smaller or personal-sized, hard-sided coolers or soft-sided coolers such as totes and lunch-box sized, soft-sided coolers. More specifically, storage racks 300 can store two such coolers (one on each of the upward pointing arcuate portions 320) particularly if the coolers have internal widths between about 4 inches and about 20 inches. Turning these smaller coolers sideways on the storage rack can facilitate such uses. Or, if desired, one larger cooler (for instance a cooler having an internal width of about 14 inches) can be stored resting on both of the upward pointing arcuate portions 320. Moreover, although fabricated from stainless steel in many cases, storage racks 300 of the current embodiment can be used in less corrosive environments such as in a utility room, pantry, etc. where space might be at more of a premium.

Storage racks of various embodiments include other features such as re-inforcing bars coupled to the arms 304 and spokes 322 to provide additional strength to the storage racks 300 (see FIGS. 5-7). In another embodiment, storage racks 200 (see FIGS. 2-4) could be fabricated from two halves with the halves being joined together by a telescoping section. For instance, one of the halves could include a hollow section into which the other half slides so that the resulting storage rack 200 has an adjustable width. In yet another embodiment, storage racks could be fabricated from sections of PVC pipe (or pipes of some other material). A pair of these pipe sections would form the arms 204 with the third pipe section coupled to the arms 304 via piping elbows to form the spacer 202. Storage racks 200 (and 300) of various embodiments could be formed by molding, die casting, forging, etc. various materials such as stainless steel, wrought iron, brass, thermosetting plastics, etc. For some such storage racks mounting hardware can be supplied instead of forming the mounting holes and/or hardware integrally with the rest of these storage racks.

Embodiments disclosed herein and their equivalents can provide a number of advantages. For instance, one size of storage rack can accommodate a large number of coolers of varying types. Coolers stored on such storage racks are less likely to grow mold and if they do they tend to do so at a decreased rate. Storage racks of embodiments will therefore be clean, dry, and ready for use even though they can be stored up on a wall and/or out of the way. Additionally, storage racks of embodiments decrease the amount of labor, time, and expense associated with cleaning and drying coolers stored thereon. The curvlinear configuration of some storage racks also facilitates low-cost fabrication of the same.

As noted elsewhere herein, storage racks of various embodiments can be sized to correspond to various coolers. Table 1 lists some frequently used types of coolers, their approximate internal dimensions, and suggested dimensions for storage racks for use therewith.

CONCLUSION

Although the subject matter has been disclosed in language specific to structural features and/or methodological acts, it is to be understood that the subject matter defined in the appended claims is not necessarily limited to the specific features or acts disclosed above. Rather, the specific features and acts described herein are disclosed as illustrative implementations of the claims.

The invention claimed is:

1. An apparatus comprising:

a cooler which defines a depth, a height, and a first side and a second side spaced apart by a width, the cooler defining a first upright orientation wherein the cooler to hold items to be kept cool in the cooler; and a continuous, curvilinear storage-rack no more than approximately 20 inches wide by approximately 16 inches in height by approximately 8 inches deep wherein the storage-rack is formed from a ⅜ inch diameter rod and defines:

a first support;

a first standoff portion coupled to the first support along a first direction and extending from the first support along a second direction perpendicular to the first direction;

a first arm coupled to the first standoff portion and being at least partially oriented along the first direction;

a spacer coupled to the first arm and at least partially oriented along a third direction generally perpendicular to the first and second directions; and a second arm, second standoff portion, and a second support spaced apart from the first arm, first standoff portion, and first support by about no more than the width of the cooler and being generally symmetrical with the first arm, first standoff portion, and first support respectively; and wherein the cooler hangs from the storage-rack generally in a second orientation inverted from the first orientation.

2. The apparatus of claim 1 wherein the storage rack is no more than approximately 14½ inches wide by approximately 6½ inches in height by approximately 8 inches deep.

3. An apparatus comprising:

a cooler which defines a depth, a height, and a first side, a second side spaced apart by a width, the cooler defining a first upright orientation wherein the cooler to hold items to be kept cool in the cooler; and a storage-rack defining:

a first support;

a first standoff portion coupled to the first support by a portion of the first standoff portion along a first direction and extending at least partially along a second direction perpendicular to the first direction;

a first arm coupled to the first standoff portion and being at least partially oriented along the first direction;

a spacer coupled to the first arm and at least partially oriented along a third direction generally perpendicular to the first and second directions; and a second arm, second standoff portion, and a second support spaced apart from the first arm, first standoff portion, and first support by about no more than the width of the cooler and being generally symmetrical with the first arm, first standoff portion, and first support respectively; and wherein cooler hangs from the storage-rack generally in a second orientation at least partially inverted from the first orientation.

4. The apparatus of claim 3 wherein the cooler further comprises a lid and wherein the lid hangs in an open position.

5. The apparatus of claim 3 wherein the cooler further comprises a zipper and wherein the zipper is in an open position.

6. The apparatus of claim 3 wherein the storage-rack is approximately 20 inches wide by approximately 16 inches in height by approximately 8 inches deep.

7. The apparatus of claim 3 wherein the storage-rack is approximately 14½ inches wide by approximately 6½ inches in height by approximately 8 inches deep.

8. The apparatus of claim 3 wherein the storage-rack is a continuous, curvilinear, and heavy gauge wire.

9. The apparatus of claim 3 wherein the storage-rack is a continuous, curvilinear rod.

10. A storage-rack for a cooler which defines a depth, a height, and a first side and a second side spaced apart by a width, the storage-rack comprising:

a first support defining a first direction;

a first standoff portion coupled to the first support and extending from the first support along a second direction generally perpendicular to the first direction;

a first arm coupled to the first standoff portion and being at least partially oriented along the first direction;

a spacer coupled to the first arm and at least partially oriented along a third direction generally perpendicular to the first and second directions and defining an undulating portion thereof; and a second arm, second standoff portion, and a second support spaced apart from the first arm, first standoff portion, and first support by about no more than the width of the cooler and being generally symmetrical with the first arm, first standoff portion, and first support respectively.

11. The storage-rack of claim 10 wherein the support defines a loop adapted to receive a fastener.

12. The storage-rack of claim 10 wherein the spacer defines a straight portion.

13. The storage-rack of claim 10 wherein the spacer defines at least one other standoff portion.

14. The storage-rack of claim 10 wherein the storage-rack is approximately 20 inches wide by approximately 16 inches in height by approximately 8 inches deep.

15. The storage-rack of claim 10 wherein the storage-rack is approximately 14 and ½ inches wide by approximately 6 and ½ inches in height by approximately 8 and ½ inches deep.

16. The storage-rack of claim 10 wherein the storage-rack is a continuous, curvilinear, and heavy gauge wire.

17. The storage-rack of claim 10 wherein the storage-rack is a continuous, curvilinear rod.

18. The storage-rack of claim 10 wherein the arms and the spacer define a first plane and the supports define a second plane.

19. The storage-rack of claim 18 wherein the planes defined by the supports and by the arms and spacer intersect.

20. The storage-rack of claim 18 wherein the storage rack is continuous and curvilinear.

* * * * *